US008142267B2

(12) United States Patent
Adams

(10) Patent No.: US 8,142,267 B2
(45) Date of Patent: Mar. 27, 2012

(54) METHOD AND SYSTEM FOR TRAINING A BASEBALL PLAYER

(76) Inventor: Derek Adams, Ossining, NY (US)

( * ) Notice: Subject to any disclaimer, the term of this patent is extended or adjusted under 35 U.S.C. 154(b) by 644 days.

(21) Appl. No.: 12/193,157

(22) Filed: Aug. 18, 2008

(65) Prior Publication Data

US 2010/0041498 A1 Feb. 18, 2010

(51) Int. Cl.
*A63F 9/24* (2006.01)

(52) U.S. Cl. ..... 463/2; 463/4

(58) Field of Classification Search ..... 473/422; 463/2, 4

See application file for complete search history.

(56) References Cited

U.S. PATENT DOCUMENTS 5,419,549 A * 5/1995 Galloway et al. ..... 473/431
6,292,706 B1 * 9/2001 Birch et al. ..... 700/91
6,430,997 B1 * 8/2002 French et al. ..... 73/379.04
2003/0054327 A1 * 3/2003 Evensen ..... 434/252

* cited by examiner

*Primary Examiner* — Omkar Deodhar
(74) *Attorney, Agent, or Firm* — Martin Raskin; Cozen O'Connor

(57) ABSTRACT

A method of training a baseball pitcher comprising the steps of providing a data processor, providing data capture devices which function to capture pitching data relating to the pitcher's pitching motion at a first location and which function to capture ball arrival data relating to the arrival of the pitched ball at a second location. The method further comprises providing a database storage device for storing predetermined pitching data and inputting personal data into said data processor. The method also includes capturing pitching data by said data capture devices relating to said pitcher's pitching motion at the first location, capturing ball arrival data by said data capture devices as the ball arrives at the second location, and inputting said pitching data, ball arrival data and predetermined pitching data into said data processor. The pitching data, ball arrival data and predetermined pitching data are processed in the data processor to generate output data.

29 Claims, 9 Drawing Sheets

Pitch Sequence Selection
150

METHOD AND SYSTEM FOR TRAINING A BASEBALL PLAYER

FIELD OF THE INVENTION

The present invention relates generally to a system and method for training a baseball player. More specifically, the invention is directed to a system and method for analyzing and improving the form and mechanics of a baseball pitcher's pitching motion.

BACKGROUND OF INVENTION

Various techniques for teaching proper pitching mechanics to baseball players have been implemented over the years. Baseball players have read books, watched baseball footage and utilized different training devices to improve their skill. However, without receiving constructive feedback, the player can perpetuate bad pitching habits that may lead to injuries. Traditionally, pitching coaches have been employed to observe and critique a player's pitching ability and to provide feedback regarding the player's pitching form. A coach observes the pitcher and provides immediate feedback that the player could implement to reduce his or her risk of injury.

Video analysis has also been used for review of a baseball player's form. In a typical video analysis system, a baseball player's form and mechanics are recorded and subsequently are analyzed. Although video analysis has been an important tool in analyzing pitching mechanics, video analysis requires extensive review by an instructor and the feedback provided may be subjective depending on the angle of the camera and the experience of the instructor. Players also may not receive immediate feedback from an instructor who must spend significant time reviewing the video.

Optical detection systems have also been used to determine the body positioning of a baseball player during a pitch as well as the characteristics of a baseball in flight. These systems, however, are prone to render inaccurate readings due to interferences such as dust particles, insects, or other material that break up the line of sight between the optical beam and the baseball player or the ball.

Some systems currently in use require a player to wear additional pieces of clothing with sensors attached, such as vests or belts, in order to image the player's body motions. For example, see U.S. Pat. No. 7,264,554. The additional pieces of clothing may act as an impediment to the player's motions by weighing down certain parts of the player's body and affect the athletic motion which results in inaccurate feedback.

Current training systems currently lack elements of interactivity and competition. A baseball player who uses these current systems may only receive feedback regarding his or her own performance. The player is unable to compare his or her performance to the performance of other players who use the system. Further, potential scouts or athletic recruiters interested in finding new talent do not have the ability to search these systems.

SUMMARY OF THE INVENTION

Accordingly, it is an object of the present invention to provide a system and methods for improving the body mechanics of a baseball player.

It is another object of the present invention to provide instruction to improve the body mechanics of a baseball pitcher in order to prevent potential injuries to the baseball player's arm.

It is still another object of the present invention to provide a baseball pitcher with a way to compare his or her pitching abilities with the abilities of other professional and non-professional baseball pitchers.

It is yet another object of the present invention to provide a baseball pitcher with feedback information regarding both the pitcher's body mechanics and the characteristics of a pitched baseball in flight.

These and other objects of the present invention are attained by providing a method of training a baseball pitcher comprising the steps of providing a data processor, providing data capture devices which function to capture pitching data relating to the pitcher's pitching motion at a first location and to capture ball arrival data relating to the arrival of the pitched ball at a second location. The method further comprises providing a database storage device for storing predetermined pitching data and inputting personal data into the data processor. Pitching data relating to the pitcher's pitching motion and ball arrival data is captured by the data capture devices. The pitching, ball arrival and predetermined pitching data is inputted into the data processor and are processed in the data processor to generate output data.

A system for training a baseball pitcher comprises data capture devices which function to capture data relating to a pitcher's pitching motion at a first location and which function to capture data relating to the arrival of a pitched ball at a second location. The system also includes a data processor which receives captured data from the data capture devices, the data processor effective to generate output data from the captured data.

A system for providing access to pitching data comprises at least one system for training a baseball pitcher as described above and a central processor in communication with the at least one system over a network. The central processor is connected to a central database which receives output data from the at least one system. The central processor is structured and arranged to receive a query from a user computer, forward the query to the central database and forward responsive data to the user computer.

Other objects and advantages of the present invention will become apparent from the following descriptions, taken in connection with the accompanying drawings, wherein, by way of illustration and example, embodiments of the present invention are disclosed.

BRIEF DESCRIPTION OF DRAWINGS

A more complete appreciation of the present invention and many of the attendant advantages thereof will be readily understood by reference to the following detailed description when taken in conjunction with the accompanying drawings, in which.

DETAILED DESCRIPTION OF THE PREFERRED EMBODIMENTS

Figure 1:
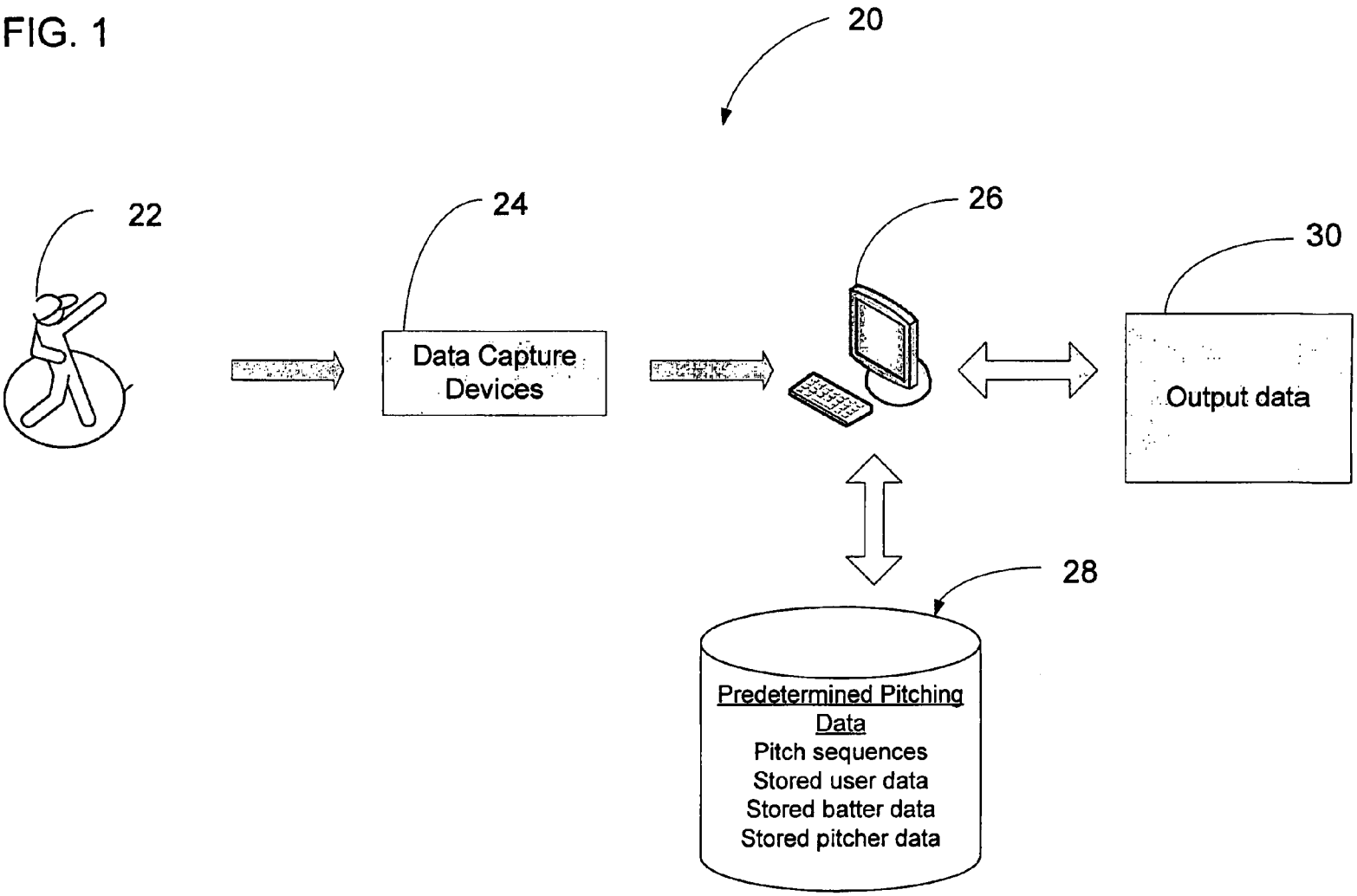
FIG. 1 is a flow chart illustrating a system for training a baseball pitcher in accordance with the present invention.

Referring now to the drawings, in which like reference characters designate identical or corresponding parts throughout the several views, a system for training a baseball pitcher, generally designated 20 is shown.

Referring to FIG. 1, system 20 includes data capture devices 24 for capturing data relating to a user 22 pitching a baseball. Data capture devices 24 may include high-speed video cameras, radar guns, and/or motion markers. Captured pitching data is transferred to data processor 26, which may be a personal computer, personal digital assistant (PDA), or any other processing device. The pitching data is processed and is converted into animation, graphical data and numerical output data relating to both user's 22 body mechanics during a pitching motion as well as the characteristics of the baseball in flight.

Data processor 26 may further access stored predetermined pitching data in database storage device 28 and compare the predetermined data with the current pitching data for generation of output data. The predetermined pitching data may include data relating to user's 22 previous pitching sessions, data relating to another user's pitching session, data including a template for pitch comparison, data relating to the statistics of professional baseball players or any other related data. Data processor 26 compares the processed pitching data with the predetermined pitching data and generates output data 30 relating to user's 22 body mechanics as well as output relating to the characteristics of the baseball in flight. Output data 30 may include multi-color charts, graphs and animation. Output data 30 may also include corrective measures and a prescribed regimen of exercises geared towards improving user's 22 body mechanics. Output data 30 is stored on database storage device 28 at the end of a pitching session and is incorporated into the predetermined pitching data. User 22 can access database storage device 28 at subsequent sessions to recover the data.

Figure 8:
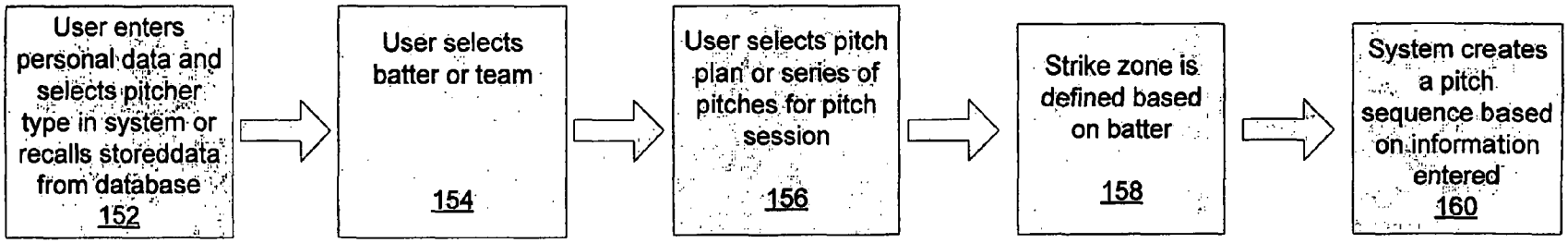
FIG. 8 is a flow chart illustrating the method of selecting a pitch sequence in accordance with the present invention.

Referring now to FIG. 8, prior to beginning a pitch session, a pitching sequence 150 is selected. As noted in block 152, a user enters personal data including his or her height, weight, handedness, age, and level of experience into the system. If the user has previously entered the personal data, he or she may recall the information from the database storage device. A user also chooses a "pitcher type," indicating what type of pitcher the user considers himself to be. For example, a user may be a control pitcher more prone to throwing curveballs or change-ups, or alternatively, the user may be a power pitcher, more prone to throwing fastballs. If the user does not know his pitcher type, the system will choose a pitcher type based on the personal data entered.

In block 154, a user next selects a batter or team. The batter or team, defined as a series of batters, may be selected from data stored on the database or, alternatively, the user can enter new information into the system to select a batter. The batter is defined on the basis of batting average, slugging percentage, on-base percentage, hit count breakdown and foul balls per inning. A user may view a scouting report indicating strengths and weaknesses of a certain batter prior to selecting the batter. This scouting report may include video analysis of the batter's strengths and weaknesses. In block 156, the user next selects a "pitch plan," a pre-defined scenario which designates the type of pitches the user is suggested to throw during a particular pitching session. The pitch plan may instruct a user to pitch certain types of pitches which would decrease the likelihood that a particular batter would hit the ball. A pitch plan may also include the type of pitch that the user will throw such as a 2 seam fastball, 4 seam fastball, curve ball, slider, change up or any other type of pitch. In block 158, a strike zone is determined based on the batter chosen. The strike zone is determined by the placement of the batter's shoulders and knees. In block 160, the system collects the entered or accessed information and creates a pitching sequence which the user is instructed to follow. The pitching sequence consists of a sequence of suggested pitches which a user is encouraged to throw to different batters. For example, if the user is designated a control pitcher, and the batter is a "power batter" who has a high batting average for inside fast balls, the pitch sequence may suggest that the user throw an outside change-up pitch.

Referring again to FIG. 1, system 20 may support a plurality of different input/output devices that are used to input or display operational information for the system. The operational information may include calibration and configuration setting inputs for system 20 and system components. For example, a touch screen display may be used to input and display operational information using a plurality of menus. Menus may be available for configuring and setting up system 20, for allowing user 22 to access system 20, for selecting preferred settings, as well as for viewing session information in various formats generated by system 20. Other input mechanisms include, but are not limited to a keyboard, a mouse, a touch pad, a joy stick, and a microphone with voice recognition software, all of which may be used to input information into system 20.

Figure 2:
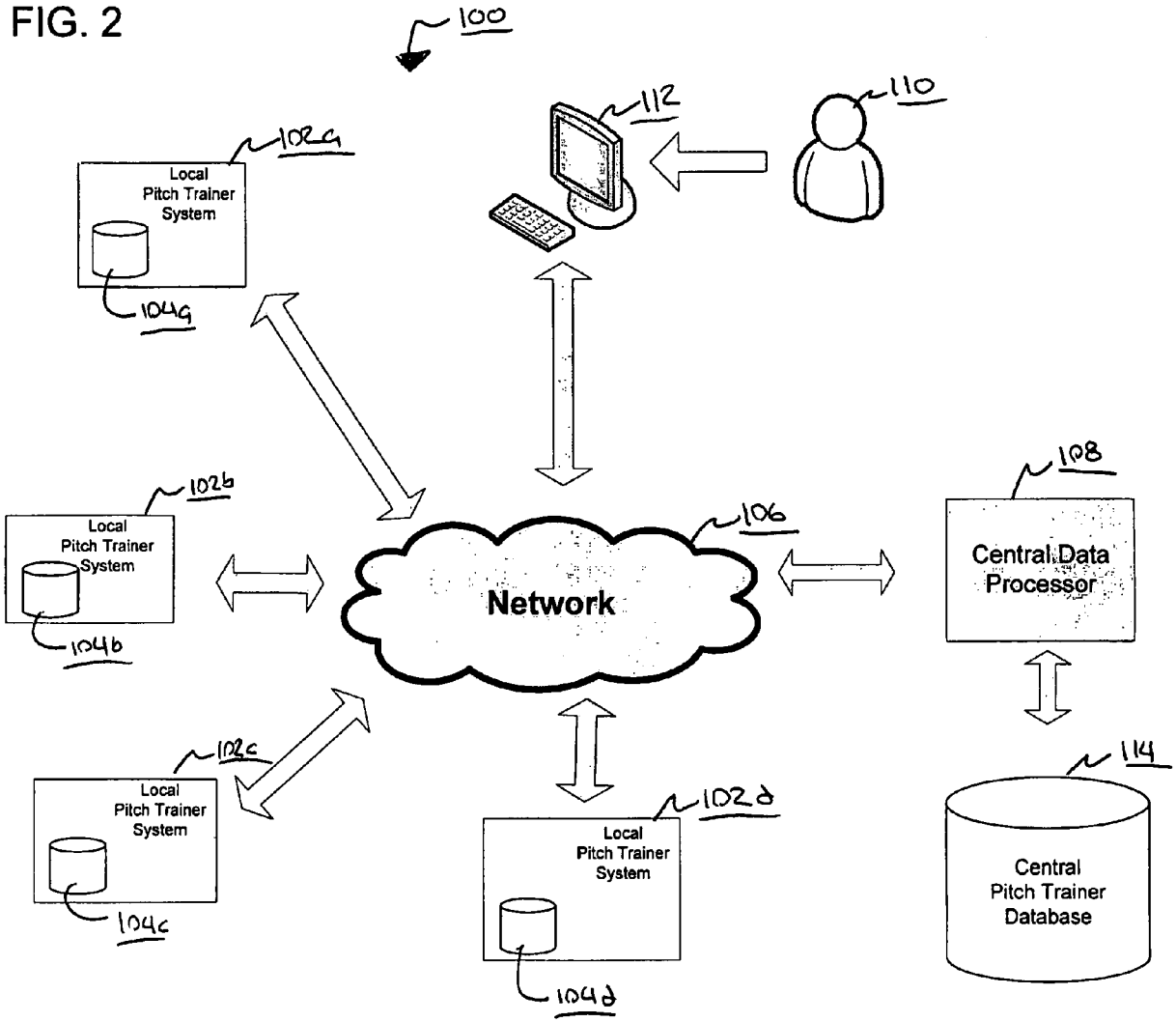
FIG. 2 is a system diagram illustrating a central processor and central database in communication with a plurality of systems for training a baseball pitcher according to FIG. 1.

Referring to FIG. 2, the system and its related components may be operated at times on a stand-alone basis, but may be connected or connectable to a remote central processor 108 and central pitch trainer database 114 via network 106 for conducting data transfer and other activities between a host and local system. Systems for training a baseball pitcher, as described in FIG. 1, are represented as 102*a*, 102*b*, 102*c*, and 102*d* and are in communication with central processor 108 through network 106. Network 106 may be wired, wireless, the Internet, an intranet or any other network. Pitching data compiled at systems 102*a*, 102*b*, 102*c* and 102*d* and stored in database storage devices 104*a*, 104*b*, 104*c*,and 104*d* are uploaded through network 106 to central pitch trainer database 114, where the pitching data is stored and organized.

A user 110, interested in searching for pitching data in system 100 can query system 100 by a sending a query through user computer 112, which is also in communication with network 106 and central processor 108. For example, user 110 may request information regarding left handed pitchers in the age range of 22-24 years old who are control pitchers. Central processor 108, in turn, queries central pitch trainer database 114 for pitching data relating to left handed pitchers in the age range of 22-24 years old who are designated in the system as control pitchers. Central data processor 108 retrieves the responsive data and forwards the data to user 110. User 110 may submit additional queries if more information is required or to refine the parameters of the query.

For example, user 110 may be a scout for a professional baseball team who intends to scout new talent for recruiting purposes. The scout may compare current users of system 100 against current or past professional baseball players and can review a variety of parameters such as, for example, the arm slot position of a specific user while executing a fastball in comparison to a current professional player. The scout can also review the video footage of a specific system user as well as three dimensional animation of the user.

User 110 may be a baseball pitcher currently using system 100, who wishes to compare his own skill level against the skill level of others of his age and size group in a geographic region. The pitcher can query system 100 and receive information regarding how his skills compare to the skills of other users. System 100 may also be utilized for competitive purposes. Different players at different locations or at the same location can compete against each other. Data, including video, numerical and graphical data relating to each of the players may be relayed to each of the locations in substantially real time in order for a player to know his or her standing. System administrators may host competitions in different regions and make rankings and standings available to users of the system.

A website may be provided for system 100, which permits a user 110 to gain access to a history of a pitcher's previous pitching sessions, a history of the pitcher's prescribed exercises, personal data, competition record, and a history of the pitcher's improvement. The website may also link user 110 to information including company information, news, system instructions, and also gives user 110 access to central pitch trainer database 114 containing a library of past performance and predetermined pitching data. The website may be configured to provide functionalities to user 110 such as exercise instructions, explanations and illustrations including text and audio/video, frequently asked questions, as well as access to relevant documents and training tips. The website may be accessed from user computer 112 or by any device with a connection to the Internet such as personal digital assistants, laptop computers, mobile phones and the like.

Individual pitch trainer systems 102*a*, 102*b*, 102*c*, and 102*d* can work in stand-alone configurations as individual test and evaluation systems for collecting user's 110 performance data, for analyzing and comparing user data to a library of performance data including professional performance data, for reporting the results, and for prescribing corrective exercises. At the end of a pitching session, the output data generated as a result of the pitching session is added to local database storage devices 104*a*, 104*b*, 104*c*,and 104*d* and may be uploaded to the central pitch trainer database 114. The new output data may be made deliverable to user 110 via on-line access or Internet services. Individual systems may share access to central pitch trainer database 114. Alternate embodiments of the invention may be directed to other athletic, occupational or rehabilitation analysis and training.

Referring to FIGS. 1 and 2, output data 30 generated upon completion of a pitching session is stored on a local database storage device 28 or may be transmitted to a central pitch trainer database 114. At database storage device 28 or at central pitch trainer database 114, output data 30 is categorized by categories including user name, geographic region, age, skill level and other searchable parameters. Output data 30 may be converted to a portable record such as a print out or may be stored electronically for later review. Output data 30 may be made available to system users for the purposes of comparison, competition or any other reason.

Figure 3:
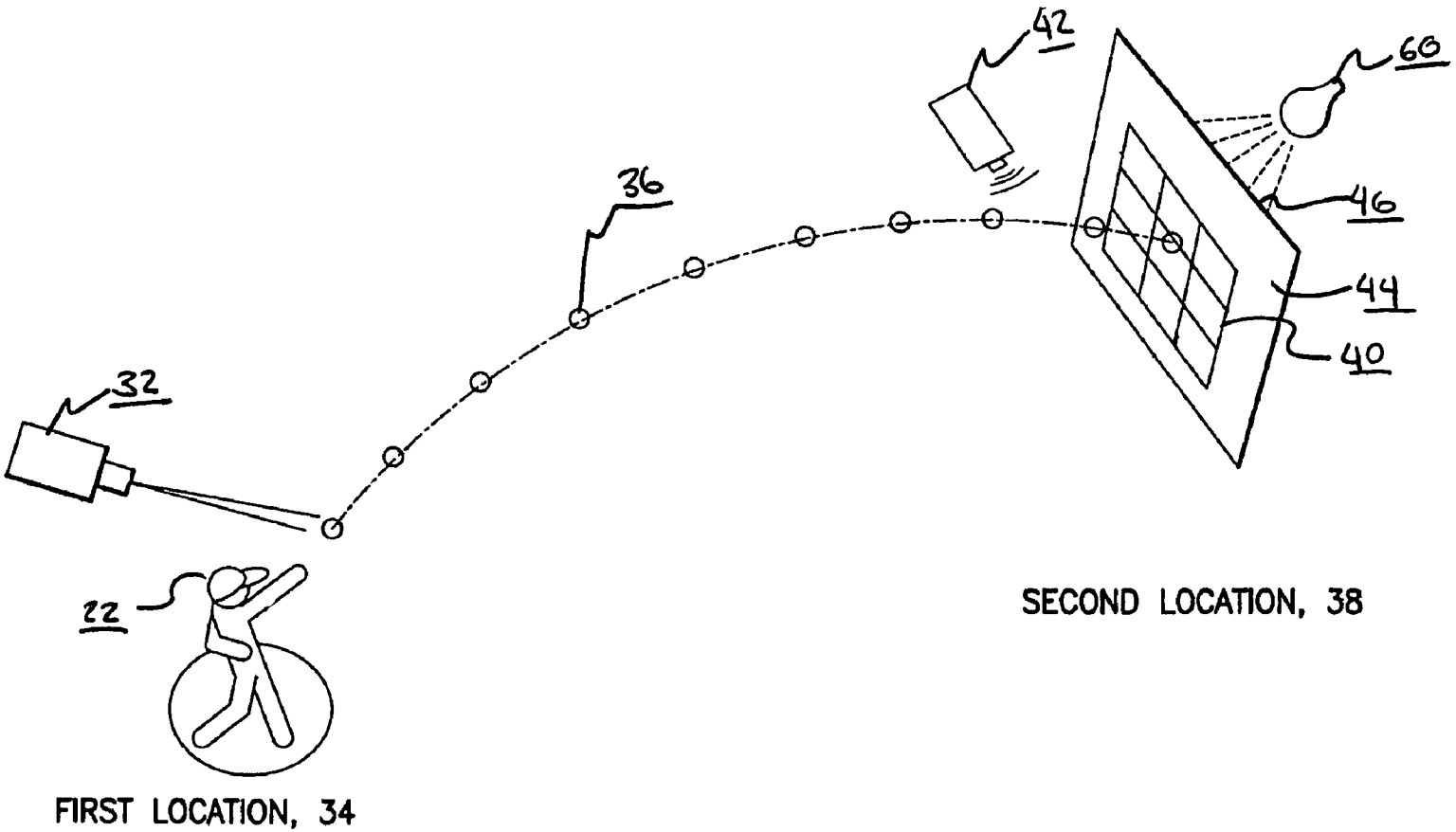
FIG. 3 is a perspective view of a system for training a baseball pitcher, wherein a video camera is positioned at a first location to capture video data relating to the arrival of a baseball at the second location.
Figure 4:
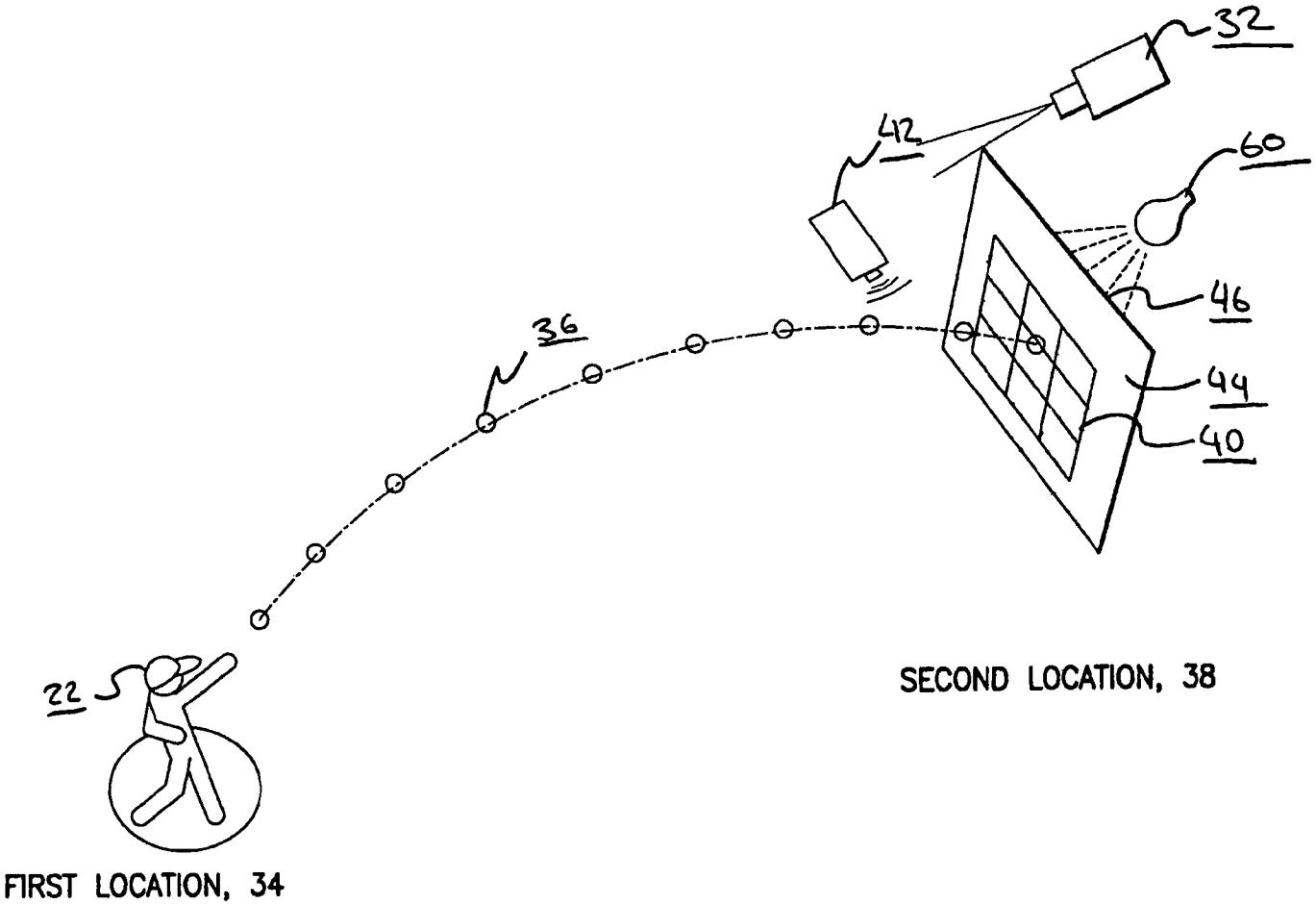
FIG. 4 is a perspective view of an embodiment of the system according to FIG. 3, wherein the video camera is positioned at a second location to capture video data relating to a pitcher's pitching motion.
Figure 5:
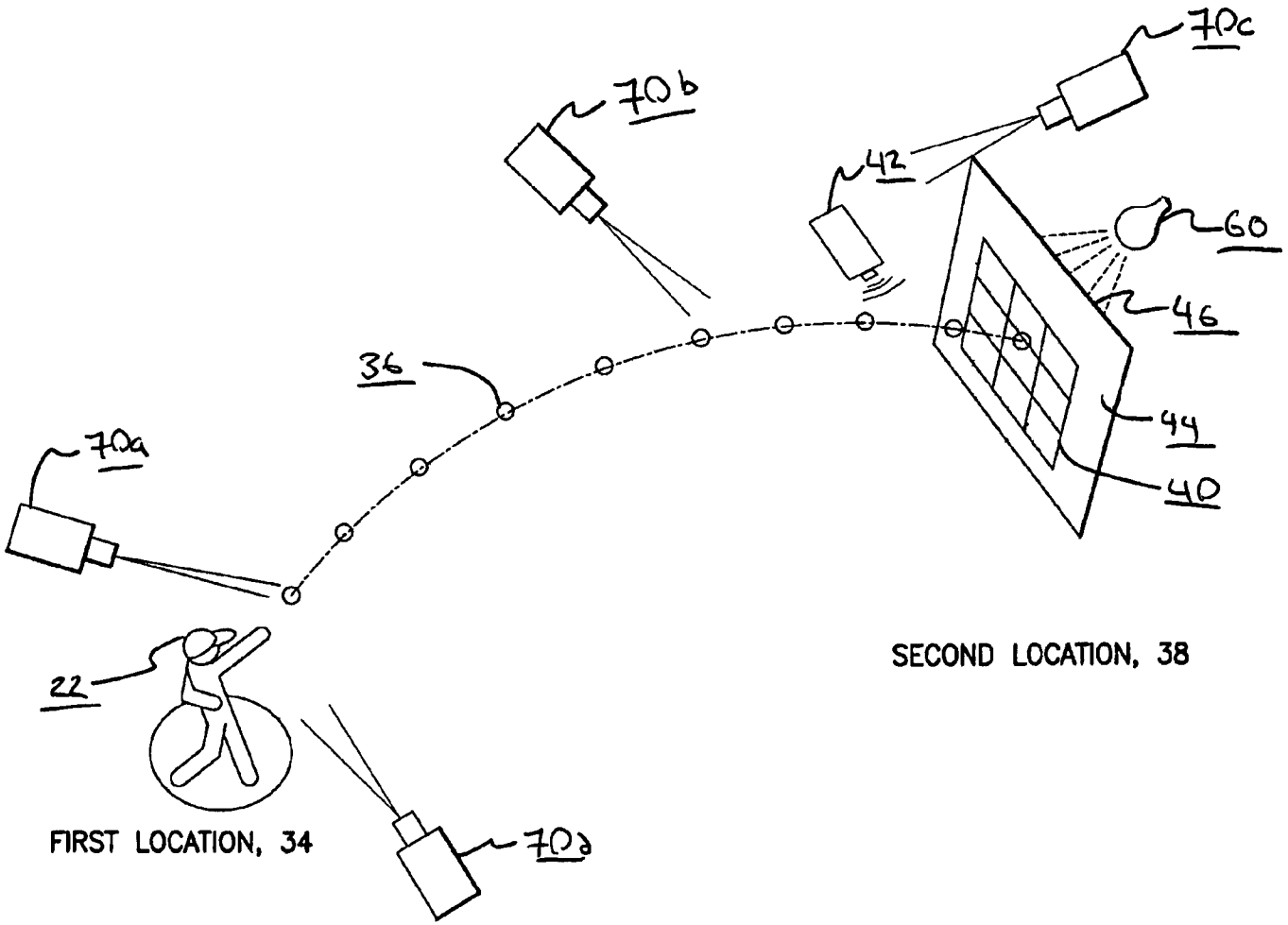
FIG. 5 is a perspective view of an embodiment of the system according to FIG. 3, wherein a plurality of video cameras are positioned to capture video data relating to the pitcher's pitching motion and video data relating to the arrival of the baseball at the second location.

Referring generally to FIGS. 3-5, various embodiments of the systems and methods of the invention are illustrated. Various devices are shown for capturing pitching data relating to the body motion of a user 22 throwing baseball 36 from a first location 34 to a second location 38 and for capturing ball arrival data of the baseball 36 arriving at second location 38, wherein first location 34 may be a pitcher's mound and second location 38 may be a home plate. The distance between first location 34 and second location 38 may be vary reflecting different skill levels and different age groups. The distance between first location 34 and second location 38 may reflect the size of professional baseball distances, little league baseball distances, or any other distances.

Referring now to FIG. 3, there is illustrated one embodiment of the system and method of the invention including data capture devices positioned to capture video data relating to baseball 36 arriving at second location 38. The data capture devices may include a video camera 32, preferably a high-speed video camera with a recording rate of at least 1,000 frames per second or greater. The high-speed video camera is preferably a high definition video camera with a recording quality of at least 480i, 720p, 1080i, or 1080p, such as the Basler 602F, manufactured by BASLER®.

Preferably, video camera 32 is positioned and directed with respect to user's 22 position, size and posture and aligned with respect to first location 34 and second location 38. Video camera 32 may also be positioned at a specific down line angle, height, and lateral position or offset. The video camera may be used to capture video data relating to the body mechanics of a batter at second location 38.

Referring now to FIG. 4, in another embodiment, video camera 32 is positioned at second location 38 to capture video data relating to user's 22 pitching motion. Video camera 32 is positioned and directed with respect to the user's 22 position, size, and posture. Video camera 32 is positioned to capture video data relating including user's 22 wind-up, pitch, release and follow-through.

Referring now to FIG. 5, in another embodiment, a plurality of data capture devices are positioned to capture the pitching motion of user 22 and the arrival of baseball 36 at second location 38. In this embodiment, a plurality of high-speed video cameras 70*a*, 70*b*, 70*c*,and 70*d* are provided adjacent to first location 34 and second location 38. Prior to beginning a pitching session, the video cameras are positioned to be directed at first location 34 and second location 38 at a predefined angles and elevations. Video cameras 70*a* and 70*b* maybe positioned to capture video data relating to the arrival of baseball 36 at second location 38. Video cameras 70*c* and 70*d* may be positioned to capture video data relating to the pitching motion of user 22 before, during and after a pitch. The video cameras may be coupled to wireless transmitters to wirelessly transmit video data to a data processor, where the video data is processed.

Additional video cameras may be positioned on additional stands oriented to capture video data relating to the pitching motion of user 22 and the ball flight and to capture video data relating to the arrival of baseball 36 at second location 38. The additional cameras may be positioned at different directions and different heights in order to collect additional video data.

Figure 7:
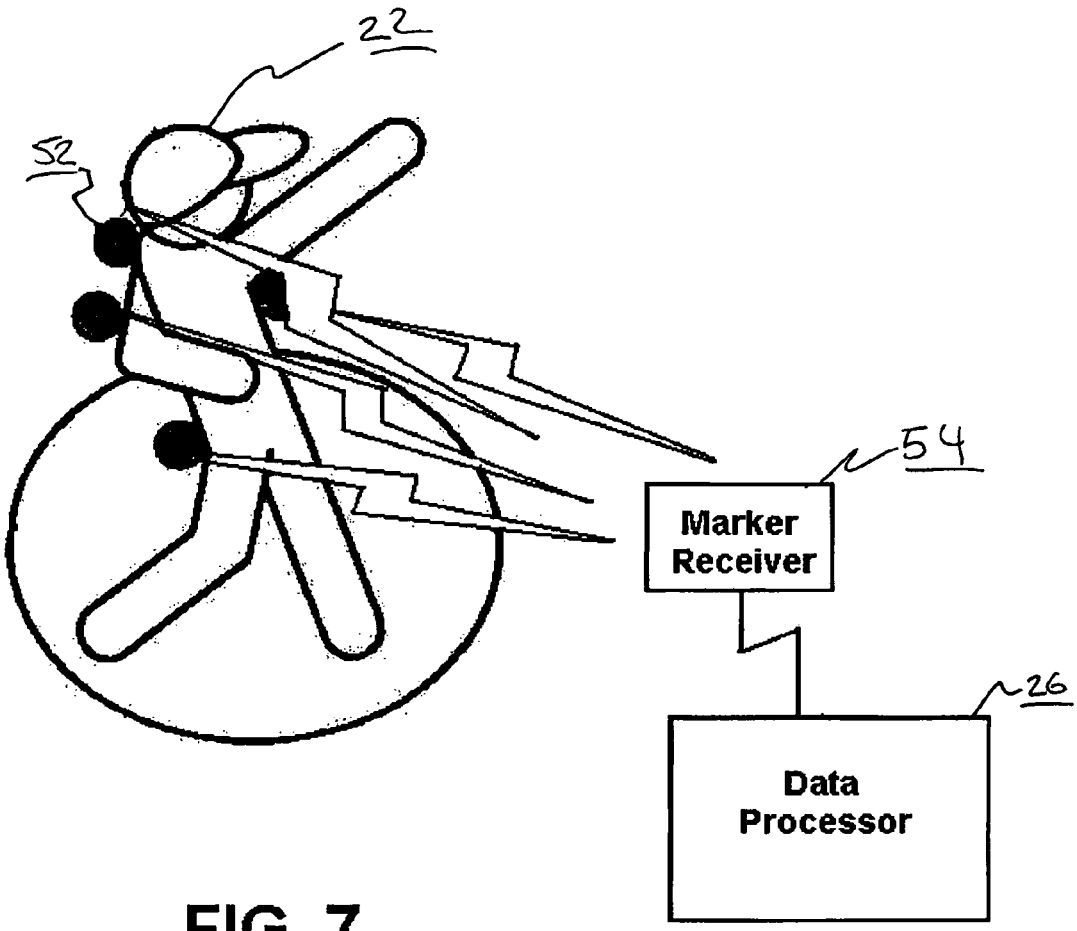
FIG. 7 is an illustration of the baseball pitcher of FIG. 3, adorned with a plurality of markers.

As shown in FIG. 7, user 22 may be adorned with a plurality of motion markers 52 such as the electromagnetic markers manufactured by LIBERTY LATUS®. Up to 12 markers are attached to user's 22 body at specific points for imaging such as the user's elbows, shoulders, hips, feet, and wrists. The markers have straps or pin attachments for attachment to targeted areas of user's 22 body. Alternatively, plurality of motion markers 52 may be manufactured into a user's 22 uniform. The markers contain an electromagnetic source, control electronics and a rechargeable lithium ion assembly.

Plurality of motion markers 52 measure and record the movements of user 22 using the electromagnetic sensors built into the motion markers. The sensors communicate electromagnetic motion data wirelessly to marker receiver 54, which contains electromagnetic receiving elements that detect electromagnetic motion data emitted by plurality of motion markers 52. Marker receiver 54 may further include a wireless transmitter for transmitting electromagnetic data to data processor 26, where the electromagnetic motion data is converted to motion data relating to the movement and anatomical positioning of user 22. Marker receiver 54 does not need to be within the line of sight of the plurality of motion markers 52 to detect the electromagnetic motion data.

Plurality of motion markers 52 are designed to be repeatedly worn by user 22 such that the markers are positioned and repositioned in the same place on the body for optimal motion sensing at selected critical points of the anatomy, particularly anatomy where sufficient electromagnetic motion data to define the initial position and the full range of motion of user 22 can be reduced by data processor 26 to component motion data, such as the motion of user's 22 elbow during a pitch. Plurality of motion markers 52 are further arranged to minimize interference with a user's 22 body motions during execution of a pitch and the markers are designed to retain body relationship to the target areas on the body of user 22 during strenuous flexing or acceleration associated with the pitching motion so that the change of position reported by each marker 52 accurately reflects the real time motion of the target area of user's 22 body.

Referring generally to FIGS. 3-5, a radar gun 42 may be provided adjacent to second location 38 to capture data relating to the velocity of baseball 36 arriving at second location 38. Radar gun 42 may be a radar gun such as the Bushnell Speedster manufactured by BUSHNELL®. Radar gun 42 transmits radio waves at an object in motion and measures the velocity of the object from the difference between the transmitted and received radio waves. Radar gun 42 may be connected to data processor by either a wired or wireless connection for transfer of baseball velocity data for analysis.

Figure 6:
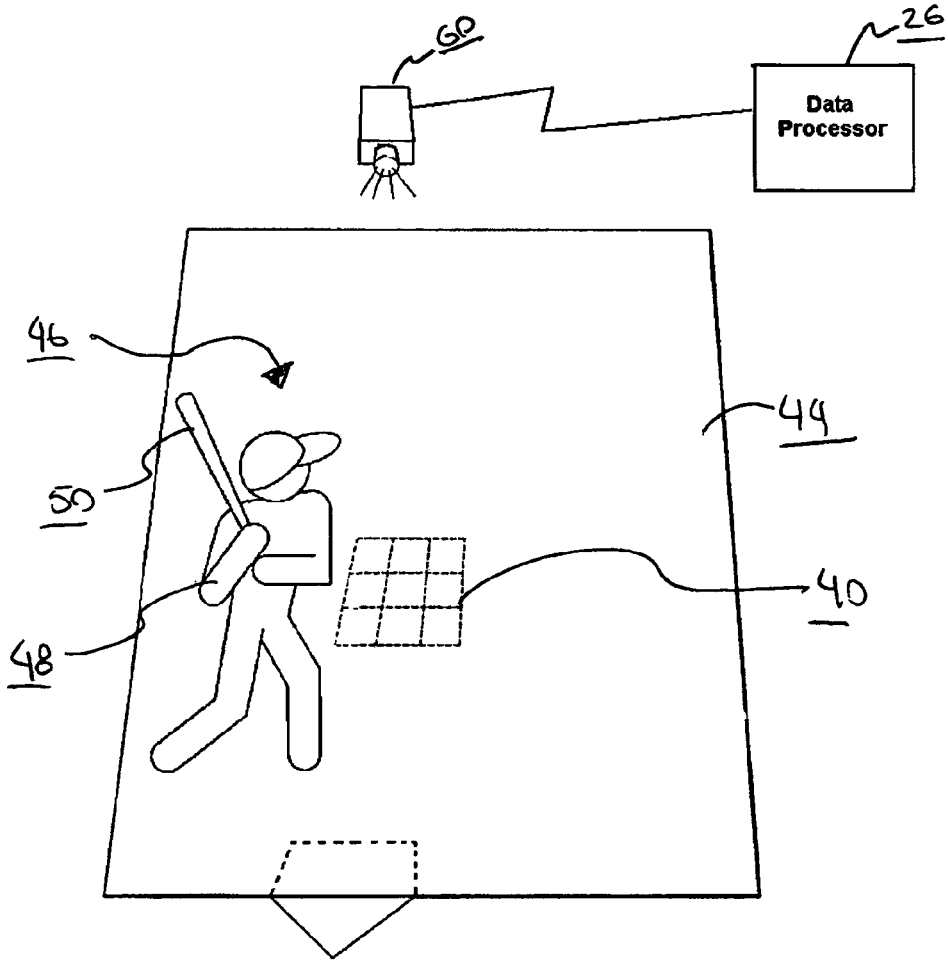
FIG. 6 is an illustration of a screen and a projection of an animated batter according to FIG. 3.

Referring generally to FIGS. 3-6, a screen 44 is positioned at second location 38, which receives and displays a projection 46. Screen 44 may be a collapsible sheet made of durable cloth or other similar material. When system 20 is not in use, screen 44 may be collapsed and stored for later use. Referring now to FIG. 6, projection 46 may include an animated baseball batter 48 with an animated baseball bat 50 and a strike zone 40. Projection 46 may be a rear projection, projected from a projector 60 onto the rear of screen 44 or projection 46 may be a frontal projection projected onto the front of screen 44.

A "strike zone," for the purposes of this application, is an imaginary plane located at a second location 34, bounded on either side by an extension of the parallel edges of a "home plate" and bordered on the top and bottom by animated baseball batter's 48 shoulders and knees, respectively. Strike zone 40 is broken up into 9 imaginary segments with three columns of equal width and three rows of equal height. When baseball 36 traverses strike zone 40 without being "hit" by animated baseball batter 48, system 20 recognizes the pitch as a "strike."

Projector 60 is connected to data processor 26, which instructs animated batter 48 to simulate a real batter's batting stance and demeanor. Animated batter 48 is generated by data processor 26 using information entered by user 22 or using information accessed from the database storage device 28 (FIG. 1), which contains animated batter templates including the templates for current and former professional baseball players. Data processor 26 sends data relating to the appearance and habits of animated batter 48 to projector 60, which projects animated batter 48 onto screen 44. After baseball 36 leaves user's 22 hand during a pitch, video data, baseball velocity data and electromagnetic motion data captured during a pitching session are processed by data processor 26. Data processor 26 uses the processed data to instruct animated batter 48 to respond to the pitch as baseball 36 approaches second location 38. For example, if video data received by data processor 26 indicates that baseball 36 will not traverse the strike zone 44, data processor 26 will instruct animated batter 48 not to swing at the baseball.

When baseball 36 does not pass through strike zone 40 and animated batter 48 does not swing at the baseball, system 20 recognizes the pitch as a "ball." A hit, according to system 20, may be determined in a number of ways. For example, a hit can be determined by whether or not baseball 36 passes through animated bat 50 of animated baseball batter 48. Hit types and foul balls are determined by how much of baseball 36 intersects with animated bat 50. For example, if a quarter of baseball 36 intersects the lower half of animated bat 50, system 20 may recognize the pitch as a hit or, more particularly, a ground ball. System 20 may utilize contrasting colors of baseball 36 and animated bat 50 to allow for better visualization.

System 20 may be controlled remotely by an operator who activates the system, calibrates the data capture devices, inputs data such as user information and pitch template, initiates data capture devices during the session or prior to each pitch, controls system output, and maintains proper system operation and adjusting system operation accordingly. The operator can be onsite or can control the system remotely over a network.

Referring again to FIG. 1, data collected during a pitching session including video data, baseball velocity data and electromagnetic motion data is transmitted to data processor 26 from each of the data capture devices. Data processor 26 processes the captured pitching and ball arrival data and uses the processed data to generate output data 30 relating to user's 22 pitching motion the arrival of the baseball. For example, data captured by plurality of electromagnetic motion markers and the high speed cameras may be processed to form a three-dimensional animation of user 22. The processed data is compared to predetermined pitching data stored on database storage device 28 and output data is generated and presented to user 22 as a comparison of the current pitching session against prior pitching sessions or the pitching sessions of other users.

Output data 30 may be provided to user 22 within less than a second or within less than 10 seconds of the initiation of the pitch depending on the type of output data that is generated. Immediate output increases the training benefits of the system. User 22 may use the immediate output to improve his or her body mechanics during a subsequent pitch.

Data processor 26 analyzes the video data, electromagnetic data and baseball velocity data received from the plurality of data capture devices, thereby allowing computation of various baseball-related parameters of interest. As an example, data processor 26 calculates arm-slot position and the angle at which user 22 turns his or her shoulders while pitching a baseball. In a typical pitching motion analysis, performance or diagnostic parameters relating to the user's pitching motion includes arm slot accuracy as measured against the arm slot accuracy of a pitching template, which contains data relating to the preferred motion for a particular pitch. For example, the mechanics of a user of a certain height and weight pitching a fastball may be compared to a template including a theoretical user of the similar height and weight throwing a fastball. User 22 is informed of the differences between his mechanics and arm slot position in comparison to the preferred mechanics and arm slot position depicted by the template. System 20 may then prescribe a regimen of exercises or a set of instructions that user 22 can use to improve his or her pitching form.

Data processor 26 also analyzes multiple characteristics relating to the arrival of a baseball at a second location including identification of pitch type, velocity, number of revolutions, type of spin, and accuracy. To analyze the characteristics of the pitched baseball using video analysis, the baseball may be isolated from the background using an image processing technique similar to a radar system. The technique eliminates all parts of the image which do not change from frame to frame, including the background. The part of the image which changes, i.e., the ball, is isolated from the background. The process is repeated for each subsequent frame, thus rendering either a composite image showing each of the ball positions of the baseball during flight or alternatively, the images may be processed together to render a video of the ball during flight. The angle of rotation of the baseball can be computed from this method. The process is repeated for each of the cameras at each different angle.

Additionally, video data may be used to determine the velocity of the baseball. The trajectory of the baseball can be defined by a series of X, Y, and Z positions in a video frame. The velocity of the baseball traveling from the first location to the second location can be determined by comparing the rate at which succeeding X, Y and Z coordinates appear in successive video frames. The speed of the baseball at any point may be determined by multiplying the distance traveled by the baseball between frames. The velocity data calculated from the video data may be compared and averaged with baseball velocity data captured from the radar gun.

Further, segments of the baseball may be color coded as reference points to indicate various positions. Data processor 26 counts the revolutions of the color coded segment of baseball 36 to determine the type of pitch, the number of rotations and the effectiveness of the pitch in comparison to a pitch template. Output data 30 is reported to user 22 in a synchronized, multi-format presentation of the pitch motion and ball motion that is available in real time and/or playback mode for optimal user and instructor assimilation. Output data 30 may include graphs, charts, animation and numerical data as well as instructive feedback to help user 22 improve his or her body mechanics. Output data 30 may be further presented solely as visual data as discussed below or as visual data in combination with pre-recorded or live audio data. For example, an instructor viewing a pitching session remotely over the Internet can offer audio advice over the system synched to specific video replay.

Figure 9:
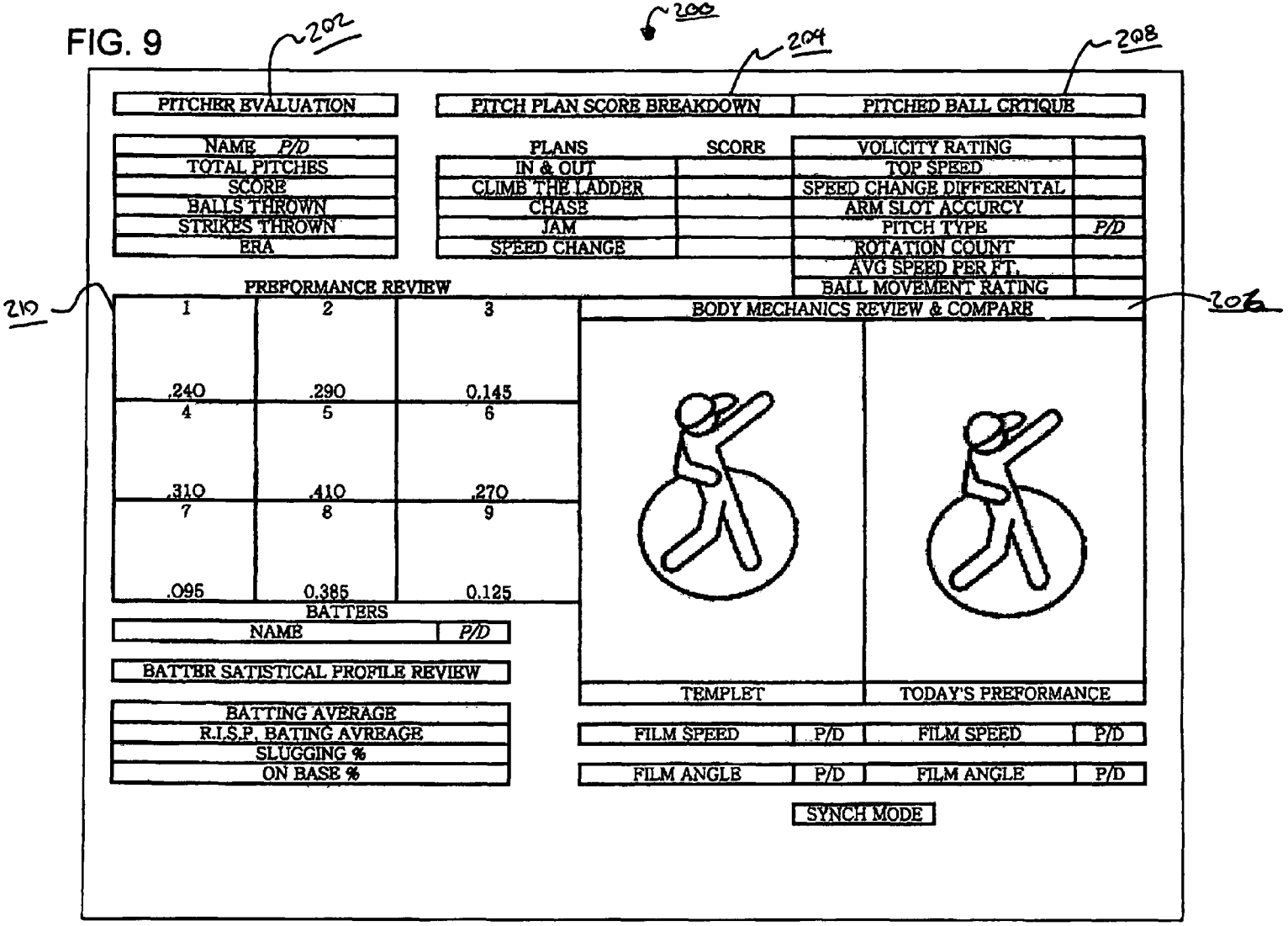
FIG. 9 is an illustration of a screen shot of the system showing a pitch trainer output data screen.

Referring now to FIG. 9, there is shown a screen shot according to the present invention of an output data screen 200. A pitcher evaluation field 202 is presented to the pitcher. The field includes the user's name, the number of pitches thrown, the user's score, the number of balls thrown, the number of strikes thrown and the pitcher's earned run average (ERA). A pitch plan score breakdown field 204 indicates the success of a user who has engaged in various pitching scenarios which place a user in different game-like situations.

A body mechanics review section 206 is shown including a pitching template screen and a performance screen. A multi-color three-dimensional animation of the user may be generated from electromagnetic motion data and video data and presented on the performance screen. The animation may be color coded to highlight particular segments of the user's body mechanics. The animation may be oriented to view the pitch motion from any angle, depending on what aspect or component of the pitch motion is being analyzed. The screen may be adjusted so that segments of the user's body may be examined in isolation. The animation of the user's body mechanics is compared on a side by side basis to an animated pitching template which depicts a preferred pitching motion for a particular type of pitch. The two screens are compared to indicate the degree of deviation and required improvement for a user to achieve a desired performance level. Playback on the screens can be paused, slowed down, or sped up to aid in analysis. Upon completion of analysis, information regarding improvements to a user's form may be presented on the screens.

Output data relating to the characteristics of a baseball may also be presented on the screens including video playback of the pitched ball or a three-dimensional animation of the pitched ball, which is generated using video data captured from the video cameras. The three dimensional animation may be a stepped frame animation for illustrating the path or motion of the baseball as it travels from the first location to the second location. Playback may be paused, slowed down, or sped up to better visualize the ball in flight.

Information regarding the characteristics of a pitched ball are also presented to the user on output data screen 200. The pitched ball critique field 208 presents information related to the velocity, top speed, speed change differential, arm slot accuracy, pitch type, rotation count, average speed per foot and ball movement rating for each pitch. Arm slot accuracy is determined, as noted above, by comparison of video data and motion data relating to a pitching motion with pitching template data relating to a preferred motion for a certain pitch. The ball movement rating is determined by comparison of various characteristics of a pitch such as velocity, rotation and accuracy to a pitch tem-plate for the specific type of pitch.

A graph of performance review 210 may be generated indicating the frequency and success level with which a user throws a certain type of pitch, such as a curve ball, to a particular portion of the strike zone against a particular batter. The information may be further presented with respect to a batter's batting average and in situations where a baseball runner is in scoring position.

This and other screen shots are within the scope of the invention and can be presented in a multi-format form, with synchronized videos and graphs. Output data may also be transmitted to a portable display that allows video, graphic and numeric values to be shown to system users such as coaches, players and spectators. Output data may provided to an on-site audience, a television audience or an Internet audience.

The invention can be realized in hardware, software or a combination of hardware and software. The invention can be realized in a centralized fashion in one computer system, or in a distributed fashion where different elements are spread across several interconnected computer systems. Any kind of computer system or other apparatus adapted for carrying out the methods described herein is suited. A typical combination of hardware and software can be a general purpose computer system with a computer program that, when being loaded and executed, controls the computer system such that it carries out the methods described herein.

The invention has been described with reference to embodiments that illustrate the principles of the invention and is not meant to limit the scope of the invention. Modifications and alterations may occur to others upon reading and understanding the preceding detailed description. It is intended that the scope of the invention be construed as including all modifications and alterations that may occur to others upon reading and understanding the preceding detailed description insofar as they come within the scope of the following claims or equivalents thereof. Various changes may be made without departing from the spirit and scope of the invention.

The invention claimed is:

1. A method for improving the body mechanics of a baseball pitcher comprising the steps of:

providing a data processor;

providing data capture devices which function to capture pitching data including data indicative of the movement of the pitcher's body during the pitcher's pitching motion;

providing a database storage device for storing predetermined pitching data indicative of a desired movement of a pitcher's body;

capturing pitching data using said data capture devices, the pitching data including data indicative of the movement of the pitcher's body during the pitcher's pitching motion;

inputting said pitching data and said predetermined pitching data into said data processor;

processing said pitching data and said predetermined pitching data to form processed data;

converting said processed pitching data and predetermined pitching data relating to said baseball pitcher's body mechanics during a pitching motion into output data;

generating said output data and comparing said generated output data to a pitch plan.

2. The method according to claim 1, wherein said data capture devices include a video camera positioned to capture video data relating to the pitcher's pitching motion.

3. The method according to claim 2, wherein said video camera is a high speed video camera.

4. The method according to claim 1, wherein said data capture devices include motion markers coupled to the pitcher's body which function to capture motion data relating to the pitcher's pitching motion.

5. The method according to claim 4, wherein said motion markers are electromagnetic motion markers.

6. The method according to claim 1, wherein said data capture devices comprise:

a high speed video camera positioned to capture video data relating to the pitcher's pitching motion; and electromagnetic motion markers coupled to the pitcher's body, which function to capture motion data relating to the pitcher's pitching motion.

7. The method according to claim 1, wherein said predetermined pitching data comprises pitcher template data relating to ideal body mechanics and body positioning of a pitcher throwing a type of pitch.

8. The method according to claim 7, wherein the type of pitch is chosen from the group consisting of a 2-seam fastball, a 4-seam fastball, a curveball, a slider, a straight change-up and a circle change-up.

9. The method according to claim 7, wherein said pitcher template data includes the motion and position of a pitcher's arm slot.

10. The method according to claim 1, wherein said output data is an animation relating to said baseball pitcher's body mechanics during a pitching motion.

11. The method according to claim 1, wherein said output data is graphical data relating to said baseball pitcher's body mechanics during a pitching motion.

12. The method according to claim 1, wherein said output data is numerical output data relating to said baseball pitcher's body mechanics during a pitching motion.

13. A method for improving the body mechanics of a baseball pitcher comprising the steps of:

providing a data processor;

providing data capture devices which function to capture pitching data including data indicative of the movement of the pitcher's body during the pitcher's pitching motion at a first location and which function to capture ball arrival data relating to the arrival of the pitched ball at a second location;

providing a database storage device for storing predetermined pitching data indicative of a desire movement of a pitcher's body;

inputting personal data into said data processor prior to throwing a pitch;

capturing pitching data by said data capture devices, the pitching data including data indicative of the movement of the pitcher's body during said pitcher's pitching motion at the first location;

capturing ball arrival data by said data capture devices as the ball arrives at the second location;

inputting said pitching, ball arrival data and predetermined pitching data into said data processor;

processing said pitching data, ball arrival data and predetermined pitching data in said data processor to form processed data;

converting said pitching data, ball arrival data and predetermined pitching data relating to said baseball pitcher's body mechanics during a pitching motion into output data;

generating said output data and comparing said generated output data to a pitch plan.

14. The method according to claim 13, wherein inputting personal data into said data processor comprises the steps of:

inputting the pitcher's name, handedness, height, weight, and age;

selecting a type of pitch which the pitcher prefers to throw; and selecting at least one baseball batter, the baseball batter generated from data stored in said database storage device.

15. The method according to claim 13, further comprising the steps of:

providing a screen at said second location;

generating an animated baseball batter on said screen, wherein the animated motions of said animated baseball batter are generated in response to said ball arrival data.

16. The method according to claim 15, wherein said animated baseball batter is selected from predetermined baseball batter data stored on said database storage device.

17. The method according to claim 16, wherein said predetermined baseball batter data includes historical data from professional baseball players.

18. The method according to claim 13, wherein the data capture devices comprise:

a first set of high speed video cameras positioned to capture video data relating to the pitcher's pitching motion;

electromagnetic motion markers coupled to the pitcher's body which function to capture motion data relating to the pitcher's pitching motion;

a second set of high speed video cameras positioned to capture video data relating to ball arrival; and a radar gun positioned to capture baseball velocity data relating to ball arrival.

19. The method according to claim 18, wherein processing said pitching data, ball arrival data and said predetermined pitch data comprises:

generating a three-dimensional animation of the pitcher's pitching motion from said video data relating to the pitcher's pitching motion and from said motion data relating to the pitcher's pitching motion;

generating a three-dimensional animation of the ball arriving at said second location from said video data relating to ball arrival; and generating numerical data relating to the arrival of the ball at said second location from video data relating to ball arrival.

20. The method according to claim 19, further comprising the step of generating a training regimen based on analysis of said pitching motion against said predetermined body motion and body position.

21. The method according to claim 19, wherein said numerical data relating to the arrival of the ball at said second location comprises velocity data, spin data, speed change differential data, rotation count data, pitch type data, top speed data and ball movement data.

22. The method according to claim 13, wherein said data processor is a handheld computing device.

23. The method according to claim 13, wherein said output data is an animation relating to said baseball pitcher's body mechanics during a pitching motion.

24. The method according to claim 13, wherein said output data is graphical data relating to said baseball pitcher's body mechanics during a pitching motion.

25. The method according to claim 13, wherein said output data is numerical output data relating to said baseball pitcher's body mechanics during a pitching motion.

26. A system for improving the body mechanics of a baseball pitcher comprising:

data capture devices structured and arranged for capturing data including data indicative of the movement of the pitcher's body during the pitcher's pitching motion at a first location and for capturing data relating to the arrival of a pitched ball at a second location;

a database storage device for storing predetermined pitching data indicative of a desired movement of a pitcher's body;

a data processor for processing data including data indicative of the movement of the pitcher's body during a pitcher's pitching motion and for processing data relating to the arrival of the pitched ball;

means for converting said pitching data, ball arrival data and predetermined pitching data relating to said baseball pitcher's body mechanics during a pitching motion into output data;

means for generating said output data; and means for comparing said generated output data to a pitch plan.

27. The system for training a baseball pitcher according to claim 26, further comprising a screen positioned at said second location and an animated batter projected onto said screen.

28. A method for providing a critique of a baseball pitcher's form and mechanics comprising the steps of:

providing a data processor;

providing data capture devices which function to capture pitching data including data indicative of the movement of the pitcher's body during the pitcher's pitching motion;

providing a database storage device for storing predetermined pitching data indicative of a desired movement of a pitcher's body;

capturing pitching data using said data capture devices, the pitching data including data indicative of the movement of the pitcher's body during the pitcher's pitching motion;

inputting said pitching data and said predetermined pitching data into said data processor;

processing said pitching data and said predetermined pitching data to form processed data;

converting said processed pitching data and predetermined pitching data relating to said baseball pitcher's body mechanics during a pitching motion into output data;

generating said output data; and providing a pitched ball critique field.

29. The method according to claim 28, whereby said critique field provides a pitch plan.

* * * * *